US006924720B2

(12) United States Patent
Miura et al.

(10) Patent No.: US 6,924,720 B2
(45) Date of Patent: Aug. 2, 2005

(54) CIRCUIT BREAKER

(75) Inventors: Masao Miura, Saitama (JP); Mitsuhiro Mitsushige, Saitama (JP); Koji Asakawa, Saitama (JP); Yasuhiro Takahashi, Saitama (JP); Hideto Yamagata, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/644,736

(22) Filed: Aug. 21, 2003

(65) Prior Publication Data

US 2004/0061580 A1 Apr. 1, 2004

(30) Foreign Application Priority Data

Sep. 26, 2002 (JP) ..... 2002-280548

(51) Int. Cl.[7] ..... H01H 9/20

(52) U.S. Cl. ..... 335/165; 335/172; 335/174; 335/16

(58) Field of Search ..... 335/6, 16, 147, 335/195, 164–176, 23–25

(56) References Cited

U.S. PATENT DOCUMENTS 3,560,683 A * 2/1971 Maier et al. ..... 218/21
3,605,052 A * 9/1971 Dimond et al. ..... 335/166
5,184,717 A * 2/1993 Chou et al. ..... 200/401
5,260,533 A * 11/1993 Livesey et al. ..... 200/401
5,290,982 A * 3/1994 Beck et al. ..... 200/401
5,296,664 A * 3/1994 Crookston et al. ..... 200/401

FOREIGN PATENT DOCUMENTS

JP 1-36652 8/1989

* cited by examiner

*Primary Examiner*—Lincoln Donovan
(74) *Attorney, Agent, or Firm*—Manabu Kanesaka

(57) ABSTRACT

A circuit breaker includes a movable contact, a fixed contact, a switching device, a switching operation handle, and an over-current tripping device. The switching device has a switching lever connected to the handle, a toggle linkage having an upper link and a lower link for connecting to the movable contact, a tripping mechanism for activating the toggle linkage in response to over-current, and an operation spring tightly stretched between the switching lever and the toggle linkage. A locking member is provided in the switching device for interconnecting the toggle linkage and the switching lever and for restricting a movement range of the switching lever according to an operational position of the toggle linkage. When main-circuit contact points are stuck, the locking member restricts the movement of the switching lever and prevents the handle from moving to the OFF position.

2 Claims, 4 Drawing Sheets

CIRCUIT BREAKER

BACKGROUND OF THE INVENTION AND RELATED ART STATEMENT

The invention relates to a circuit breaker applied to a circuit breaker or an earth-leakage breaker for a low-voltage circuit. More specifically, the invention relates to a switching device equipped with an isolation function for preventing an operation handle from moving to an OFF position in a state that main-circuit contact points are stuck due to an abnormal current.

FIG. 5 shows a configuration of a circuit breaker as an example. In the figure, reference numeral 1 denotes a case (mold case) of the circuit breaker, reference numeral 2 denotes a main-circuit terminal at a power-source side, reference numeral 3 denotes a main-circuit terminal at a load side, reference numeral 4 denotes a fixed contact, reference numeral 5 denotes a movable contact, reference numeral 6 denotes an earth-leakage breaker, reference numeral 7 denotes a contact holder for the movable contact 5, reference numeral 8 denotes a switching device, reference numeral 9 denotes a switching operation handle, and reference numeral 10 denotes a bimetal-type over-current tripping device.

The switching device 8 has a configuration wherein the following constituent members are assembled to an assembly frame (side plate) 18 of the switching device: a swing-type switching lever 11 connected to the handle 9; a toggle linkage 15 having a link shaft 14 for connecting an upper link 12 and a lower link 13, and bridging between the movable contact 5 and a latch (trip lever); a tripping device 16 formed of a lever-shaped latch 16*a* and a latch receipt 16*b* for releasing the latch 16*a* in response to a movement of the over-current tripping device 10; and an operation spring (tension coil spring) 17 tightly stretched between the switching lever 11 and the link shaft 14 of the toggle linkage.

An operation of switching the circuit breaker is well known. When the handle 9 is operated to move from the ON position to the OFF position shown in the figure, the upper link 12 and the lower link 13 of the toggle linkage 15 are folded or bent by a spring force of the operation spring 17, and the movable contact 5 is opened in conjunction with the folding.

When an over-current flows in an electrified state to activate the over-current tripping device 10, an output of the over-current tripping device 10 activates the tripping mechanism 16 to release the latch 16*a* latched by the latch receiver 16*b*. As a result, the latch 16*a* rotates counterclockwise, and the switching device 8 performs tripping, so that the movable contact 5 is opened to cut off the current. In addition, as a result of the tripping, the handle 9 moves together with the switching lever 11 to an intermediate position between the ON position and the OFF position, thereby indicating the occurrence of the tripping. In order to turn on the circuit breaker again after the tripping, it is necessary only to move the handle 9 to the OFF position temporarily to reset the tripping mechanism 16, and then move the handle 9 back to the ON position to close the movable contact 5.

In the circuit breaker, the fixed contact point and the movable contact point may be stuck when an abnormal current flows through the main circuit in the electrified state and the main-circuit contact points are closed. In this case, even though the over-current tripping device 10 operates normally, the movable contact 5 is not opened, and the main-circuit contact points remain in contact. Incidentally, the handle 9 stops at the ON position in this state.

Further, in the structure of the switching device described above, when the main-circuit contact points are stuck, it is still possible to move the handle 9 from the ON position to the OFF position by applying a force greater than usual to stretch the operation spring 17. Therefore, an operator may move the handle to the OFF position without knowing the abnormal state in which the contact points are stuck. In this case, if the operator mistakenly acknowledges that the breaker is disconnected, and performs maintenance and repair on the load side, there is a risk that the operator may touch a hot line and receive an electric shock.

In order to prevent such an electric-shock accident, a circuit breaker may be provided with a function (called "isolation function") for making it impossible to move the handle to the OFF position when the contact points are stuck during the electrified state. As an example of a mechanism having the function, Japanese Patent Publication (Kokai) No. 01-36652 has disclosed a configuration in which a blocking member is provided between a switching lever of a switching device and a link node (link shaft) of a toggle linkage for engaging or abutting against the components.

However, the configuration disclosed in Japanese Patent Publication (Kokai) No. 01-36652 has the following problems in terms of design and manufacture. That is, in the disclosed configuration for preventing the handle from moving to the OFF position when the contact points are stuck, a blocking mechanism is formed of the link shaft of the toggle linkage and the notch formed in the switching lever at a side opposite to the link shaft or a folded engagement part formed at a side edge of the switching lever. When the contact points are stuck, the notch formed in the switching lever or the folded engagement part engages or abuts against the link shaft of the toggle linkage, so that the handle is not moved to the OFF position.

In the configuration described above, the link shaft of the toggle linkage needs to directly engage or abut against the notch or folded engagement part formed in the switching lever. Thus, it is necessary to carefully consider a shape of the notch or folded engagement part and a position of the link shaft, thereby creating a limitation in the design. Further, in an assembly process, it is easy to be affected by assembly accuracy and variations.

In view of the problems described above, the invention has been developed, and an object of the invention is to provide a circuit breaker having an isolation function in which a handle is not moved to the OFF position when the contact points are stuck, by adding to a switching device with a simple additional part, so that there is no design constraint or no need to assemble accurately.

Further objects and advantages of the invention will be apparent from the following description of the invention.

SUMMARY OF THE INVENTION

In order to achieve the above-mentioned objects, according to the present invention, a circuit breaker comprises a movable contact; a fixed contact; a switching device; a switching operation handle; and an over-current tripping device. The switching device is an assembly comprising a switching lever connected to the handle; a toggle linkage having an upper link and a lower link and connected to the movable contact; a tripping mechanism for activating the toggle linkage in response to an over-current; and an operation spring tightly stretched between the switching lever and the toggle linkage. Main-circuit contact points open and close through ON and OFF operations of the handle. As means for preventing the handle from moving to the OFF position when the main-circuit contact points are stuck, a locking member is provided in the switching device for interconnecting the toggle linkage and the switching lever to restrict a movement range of the switching lever according to an operational position of the toggle linkage. When the main-circuit contact points are stuck, the locking member restricts the movement of the switching lever and prevents the handle from moving to the OFF position.

In the invention, the locking member may be formed of a locking plate having an irregularly shaped slit for restricting the movement range of the switching lever and a stopper arm. A rear end of the locking plate is pivotally supported on an assembly frame of the switching device, and the irregularly shaped slit is fit to a protrusion of the switching lever. The stopper arm is disposed so as to face a backside of the link shaft connecting the upper link and the lower link of the toggle linkage.

In the configuration, in a normal state in which the main circuit contact points are not stuck, when the handle is operated to shut off the circuit breaker, the link shaft of the toggle linkage is separated from the stopper arm of the locking plate during the operation. As a result, the locking plate is able to swing freely without any interference from the link shaft of the toggle linkage. Therefore, the locking plate does not restrict the switching lever connected to the handle, so that the switching lever can move to the OFF position together with the handle and open the movable contact.

In the invention, when the contact points are stuck due to an abnormal current, since the toggle linkage connected to the movable contact is unable to move from the ON position, the stopper arm of the locking plate abuts against the link shaft of the toggle linkage, and the locking plate is unable to rotate. Therefore, even if an operator tries to move the handle to the OFF position in this state, the protrusion formed on the switching lever is stopped in the irregularly shaped slit (bent shape) formed in the locking plate, so that the handle is prevented from moving to the OFF position.

Further, in the invention, the locking plate interconnects the switching lever and the toggle linkage as an individual part. Therefore, as compared with a conventional configuration, in which a switching lever directly engages or abuts against a toggle linkage, it is possible to obtain more flexibility in a design with fewer structural constraints. Furthermore, it is not necessary to assemble with high accuracy and small geometrical variations to obtain the desired function, thereby making it easy to secure the isolation function.

BRIEF DESCRIPTION OF THE DRAWINGS

FIG. 3 is a view showing an operation of the switching device of the embodiment when the circuit breaker is turned on;

DETAILED DESCRIPTION OF PREFERRED EMBODIMENTS

Figure 1:
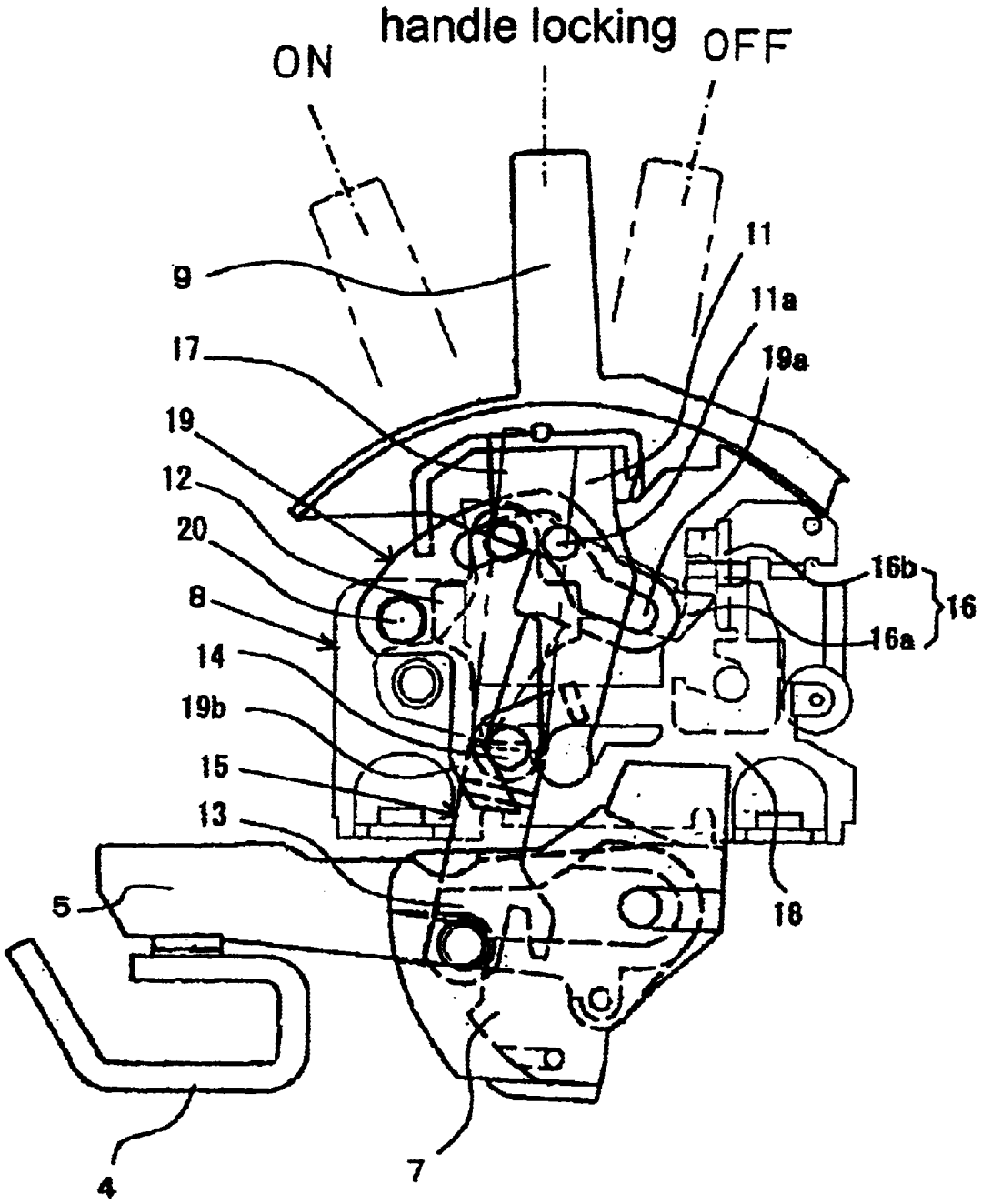
FIG. 1 is a structure diagram showing a switching device of a circuit breaker according to an embodiment of the invention in a state in which a handle is prevented from moving to an OFF position when contact points are stuck.

Hereunder, embodiments of the invention will be described with reference to the accompanying drawings. Note that in the drawing, components corresponding to those of a conventional device shown in FIG. 5 are denoted with the same reference numerals, and descriptions thereof are omitted.

Figure 5:
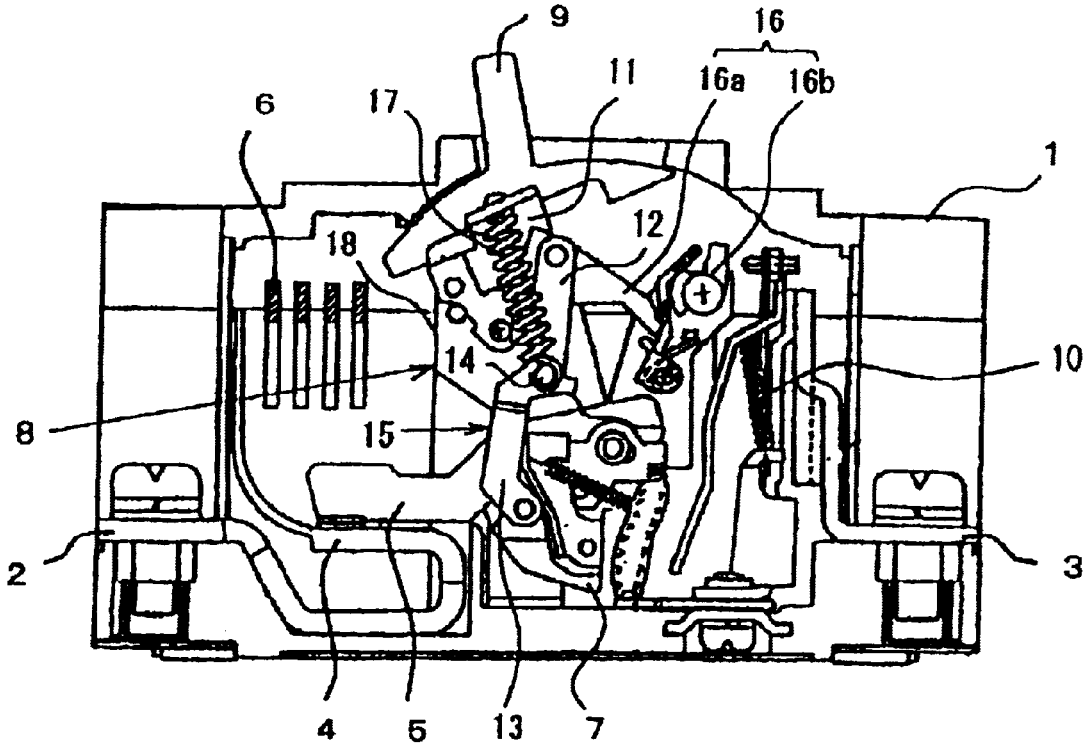
Fig. 5 Prior Art
FIG. 5 is a diagram showing a configuration of a conventional circuit breaker.

In the embodiment shown in the drawings, a fundamental structure of a switching device 8 is the same as that of the conventional device shown in FIG. 5. In addition, a locking plate 19, which is an independent part, is provided as a locking member for interconnecting a switching lever 11 and a toggle linkage 12 so as to restrict a movement range of the switching lever 11.

Figure 2:
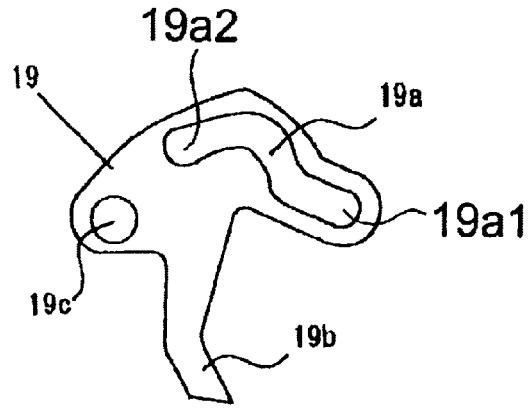
FIG. 2 is a view showing a shape of a locking plate shown in FIG. 1.

As shown in FIG. 2, the locking plate 19 is provided with an irregularly shaped slit 19*a* having a boomerang shape in a plate face thereof, i.e. linear portion 19*a*l and curved portion 19*a*2, a stopper arm 19*b* protruding downwardly, and a pivot hole 19*c* at a rear end thereof. As shown in FIG. 1, a pivot 20 is inserted into the pivot hole 19*c* to attach the locking plate 19 to an assembly frame (side plate) of the switching device 8 so that the locking plate 19 can swing freely. At this position, the irregularly shaped slit 19*a* is fit to a protrusion (pin) 11*a* provided at a side surface of the switching lever 11, and the slit arm 19*b* protruding downwardly is disposed so as to face a rear side of the link shaft 14 of the toggle linkage 15.

Figure 3:
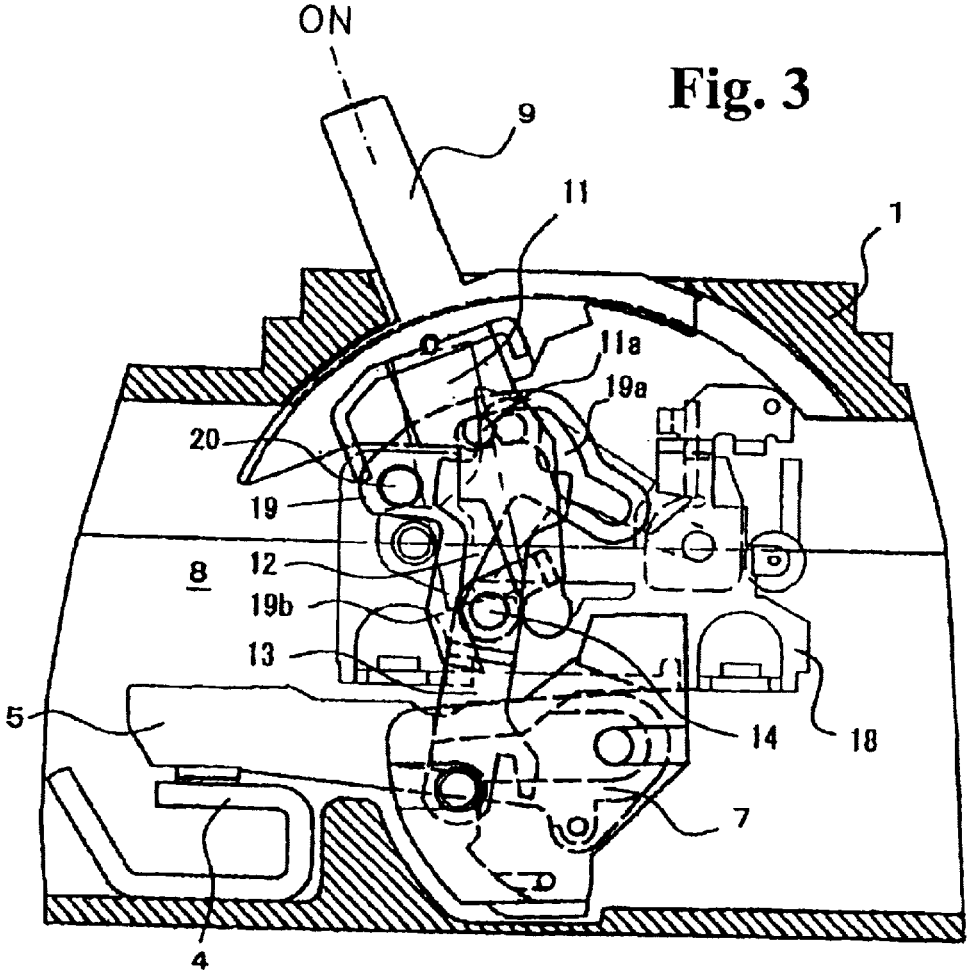

In the configuration described above, as shown in FIG. 3, when the circuit breaker is turned on (the handle is moved to the ON position), the protrusion 11*a* of the switching lever 11 connected to the handle 9 is moved to a left end of the irregularly shaped slit 19*a* of the locking plate 19. The locking plate 19 rotates counterclockwise around the pivot 20 so that the stopper arm 19*b* faces the rear side of the link shaft 14 of the toggle linkage 15. Note that FIG. 3 shows a state in which the main-circuit contact points of the fixed contact 4 and the movable contact 5 are not stuck.

Figure 4:
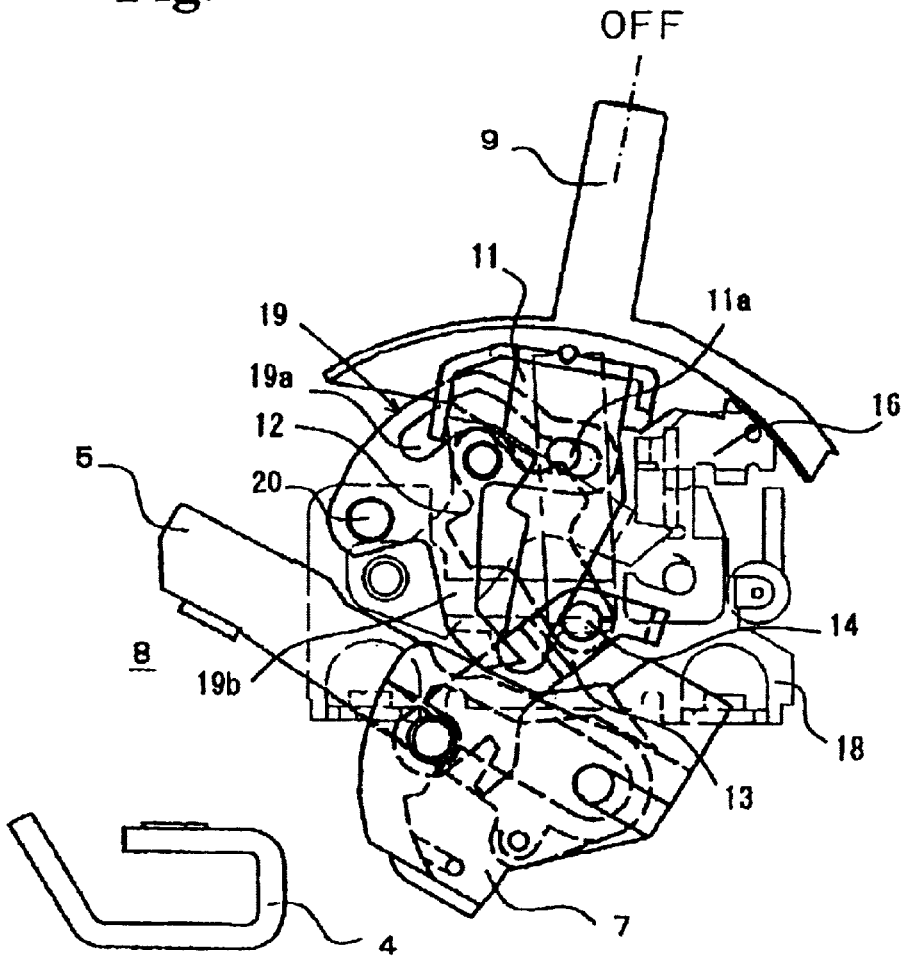
FIG. 4 is a view showing an operation of the switching device of the embodiment when the circuit breaker is shut down.

When the handle 9 is moved to the OFF position shown in FIG. 4 from the ON position shown in FIG. 3, the upper link 12 and the lower link 13 of the toggle linkage 15 are folded into a shape of a symbol "<", as explained with reference to FIG. 5. As a result, the movable contact 5 is opened by a force of the operation spring 17. At the same time, the link shaft 14 of the toggle linkage 19 moves to right from the position shown in FIG. 3 to be away from the stopper arm 19*b* of the locking plate 19. Accordingly, the locking plate 19 is able to swing freely without interfering with the link shaft 14. Also, the switching lever 11 moves to right as the protrusion 11*a* moves along the irregularly shaped slit 19*a* without being constrained by the locking plate 19, and the handle 9 moves to the OFF position and stops.

When an operator tries to move the handle 9 to the OFF position in a state that the main-circuit contact points are stuck due to an abnormal current flowing in an electrified state of the circuit breaker, the isolation function operates as described below so that the handle 9 can no longer be moved to the OFF position.

With reference to FIG. 1, the movable contact 5 does not open from the closed position when the main-circuit contact points are stuck. Thus, the toggle linkage 15 in which the lower link 13 is connected to the movable contact 5 remains stretched, as shown in the figure, and the link shaft 14 stays at the position shown in the figure. Further, the stopper arm 19*b* abuts against the link shaft 14, so that the locking plate 19 is constrained at the position and does not rotate freely around the pivot 20.

Therefore, when the operator tries to move the handle 9 from the ON position to the OFF position, the protrusion 11*a* of the switching lever 11 abuts against an inclined portion of the irregularly shaped slit 19*a* of the locking plate 19 as the handle 9 is moved. As a result, the handle 9 is restricted not to move further beyond that point. Consequently, the handle 9 stops at the handle-locking position shown in the figure, and is prevented from moving to the OFF position.

With this configuration, the handle is not moved to the OFF position when the contact points are stuck, so that it is possible to prevent an inadvertent electric-shock accident due to mistakenly acknowledging that the circuit breaker is disconnected. Furthermore, the circuit breaker is configured such that the switching lever 11 and the toggle linkage 15 are interconnected through the locking plate 19, which is an independent part. Therefore, there are fewer structural constraints as compared to the configuration of the conventional circuit breaker. It is necessary to install only the locking member to the switching device of the circuit breaker, thereby making a design of the device more flexible. It is possible to obtain the stable operation and secure function without an effect of assembly error involving the product.

As described above, according to the invention, the circuit breaker has the switching device including the switching lever connected to the handle; the toggle linkage formed of the upper link and the lower link and connected to the movable contact; the tripping mechanism for activating the toggle linkage in response to the over-current; and the operation spring tightly stretched between the switching lever and the toggle linkage. The locking member is attached to the switching device for interconnecting the toggle linkage and the switching lever so as to restrict the movement range of the switching lever according to the position of the toggle linkage as means for preventing the handle from moving to the OFF position when the main-circuit contact points are stuck.

The locking member is formed of the locking plate including the irregularly shaped slit for restricting the movement range of the switching lever and the stopper arm on the plate face thereof. The rear end of the locking plate is pivotally supported on the assembly frame of the switching device. The irregularly shaped slit is fit to the protrusion of the switching lever, and the stopper arm is disposed so as to face the rear side of the link shaft connecting the upper link and the lower link of the toggle linkage.

With this configuration, the handle does not move to the OFF position when the contact points are stuck, so that it is possible to prevent an inadvertent electric-shock accident due to mistakenly acknowledging that the circuit breaker is disconnected. Furthermore, it is configured that the switching lever and the toggle linkage are interconnected through the locking plate that is an independent part. Therefore, there are fewer structural constraints, thereby making a design of the device more flexible. It is possible to obtain the stable operation and secure function without an effect of assembly error involving the product.

While the invention has been explained with reference to the specific embodiments of the invention, the explanation is illustrative and the invention is limited only by the appended claims.

What is claimed is:

1. A circuit breaker comprising:

a fixed contact, a movable contact movably arranged to the fixed contact, an operation handle moving between an ON position and an OFF position for opening and closing the movable contact, a switching device including a switching lever connected to the operation handle and having a protrusion, a toggle linkage connected to the movable contact and having a link shaft, and upper and lower links connected by the link shaft, a tripping mechanism for activating the toggle linkage in response to an over-current, and an operation spring disposed between the switching lever and the toggle linkage, an over-current tripping device connected to the switching device for performing a tripping operation in response to the over-current, and a locking member attached to the switching device for interconnecting the toggle linkage and the switching lever to restrict a movement range of the switching lever according to a position of the toggle linkage so that when the movable contact is stuck to the fixed contact, the locking member prevents the handle from moving to the OFF position by restraining a movement of the switching lever, said locking member being formed in a plate shape including an irregularly shaped slit fitted in the protrusion of the switching lever for restricting the movement range of the switching lever, and a stopper arm disposed adjacent to the link shaft of the toggle linkage, said locking member having a rear end pivotally supported on the switching device.

2. A circuit breaker according to claim 1, wherein said slit has a curved portion and a linear portion extending from the curved portion.

* * * * *